US005236128A

United States Patent [19]

Morita et al.

[11] Patent Number: 5,236,128

[45] Date of Patent: Aug. 17, 1993

[54] SPRAY GUN WITH PAINT SUPPLY AMOUNT CONTROL

[75] Inventors: Nobuyoshi Morita; Satoru Murata, both of Yokohama, Japan

[73] Assignee: Iwata Air Compressor Mfg. Co., Ltd., Tokyo, Japan

[21] Appl. No.: 511,771

[22] Filed: Apr. 20, 1990

[30] Foreign Application Priority Data

Aug. 11, 1989 [JP] Japan ..... 1-209442

[51] Int. Cl.[5] ..... B05B 7/12

[52] U.S. Cl. ..... 239/407; 239/365; 239/367

[58] Field of Search ..... 239/300, 427, 290, 337, 239/424, 407, 302, 339, 364, 365, 367

[56] References Cited

U.S. PATENT DOCUMENTS

| | | | |
|---|---|---|---|
| 1,710,435 | 4/1929 | Shelburne | 239/337 |
| 2,249,771 | 7/1941 | MacMartin | 239/300 |
| 2,959,358 | 11/1960 | Vork | 239/290 |
| 3,027,096 | 3/1962 | Giordano | 239/424 |
| 3,055,596 | 9/1962 | Pope | 239/424 |
| 3,469,788 | 9/1969 | Glaros | 239/373 |
| 3,507,451 | 4/1970 | Johnson | 239/290 |
| 3,924,806 | 12/1975 | Schowiak | 239/427 |
| 4,174,071 | 11/1979 | Lau et al. | 239/365 |
| 4,760,962 | 8/1988 | Wheeler | 239/373 |
| 4,934,602 | 6/1990 | Mattson | 239/300 |
| 5,054,687 | 10/1991 | Burns et al. | 239/337 |
| 5,119,992 | 6/1992 | Grime | 239/364 |

FOREIGN PATENT DOCUMENTS

| | | | |
|---|---|---|---|
| 504615 | 7/1951 | Belgium | 239/365 |
| 548727 | 4/1932 | Fed. Rep. of Germany | 239/365 |
| 1170117 | 1/1958 | France | 239/365 |

*Primary Examiner*—Andres Kashnikow
*Assistant Examiner*—Christopher G. Trainor
*Attorney, Agent, or Firm*—Wenderoth, Lind & Ponack

[57] ABSTRACT

A premixing-type spray gun which mixes a paint and compressed air inside the atomizing head thereof and sprays out the mixture as atomized from the spray hole, having a flow control valve to adjust the sectional area of the paint supply path communicating with the paint nozzle or having a relief valve disposed downstream of a throttle path made of the inlet path through which the spraying air pressure is partially supplied into the pressurizing container.

The flow rate of the paint can be adjusted independently of the trigger operation of the spray gun, and the amount of the paint suppled under pressure can be controlled, thereby keeping a stable spray amount.

4 Claims, 2 Drawing Sheets

SPRAY GUN WITH PAINT SUPPLY AMOUNT CONTROL

BACKGROUND OF THE INVENTION

1. Field of the Invention

The present invention relates to a premixing-type spray gun which mixes paint and compressed air inside an atomizing head and sprays the atomized mixture from a spray hole, and more particularly to such a spray gun having a paint supply amount control.

2. Description of the Prior Art

Premixing-type spray guns are well known. The conventional premixing-type spray gun is of such a construction that spraying air and paint are blown separately into a spray hole. Back pressure is applied to the outlet of the paint nozzle, and the higher the spraying pressure, the more the amount of sprayed paint is limited, having an influence on the finish of the paint-sprayed surface.

Generally, the paint nozzle of the spray gun is provided with a needle valve therein, and the amount of paint sprayed can be adjusted due to an increase in the sectional aperture area when the needle valve moves back. However, the needle valve does not sufficiently move back when the blow-out amount is limited. Therefore, the spray trigger is not fully pulled, but stopped at a mid-way point. The needle valve is provided at the rear thereof with a paint spray-amount control knob to which the trigger, that is, the rear end of the needle, can be pulled.

Thus the trigger cannot be fully pulled back, and the operability of the spray gun is poor.

The spray hole of the paint nozzle has its opening area limited by the end of the needle valve, and thus it is not assured that the spray aperature shape can be held in the correct shape. There is a great possibility that the spraying will vary. That is, if the needle valve end is positioned at the center of the circular spray hole, the paint is uniformly blown out from the circular clearance of the spray hole. However, when the end of the needle valve is placed eccentrically to either side of the circular spray hole, the blow-out clearance is not uniform, resulting in an irregular blow-out.

Hence, the spray hole should, desirably, be so formed that the paint is blown out while the correct blow-out aperture is being held with the needle valve positively let back.

SUMMARY OF THE INVENTION

Accordingly, the present invention has the object of overcoming the above-mentioned drawbacks of the conventional techniques by providing a premixing-type spray gun having a means for controlling the paint supply amount by adjusting the flow path sectional area of the paint path without interference with the trigger operation.

According to one aspect of the present invention, there is provided a premixing-type spray gun which mixes paint and air inside an air cap and has a flow control valve for adjusting the flow path sectional area provided in a paint path communicating with a paint nozzle.

According to another aspect of the present invention, there is provided a premixing-type spray gun equipped with a dripfree mechanism in which a nozzle is disposed at two stages in the inlet of a pressurizing container.

According to still another aspect of the present invention, a dripfree mechanism is provided in which a nozzle is disposed at two stages on the inlet of the pressurizing container.

Because of the above-described construction, as the spraying pressure changes, the pressure applied to the outlet of the paint nozzle also changes, corresponding to the spraying pressure change. Along with this change, the blow-out amount from the nozzle changes. However, by providing a flow control valve composed of a paint throttle valve, it is possible to control the paint supply amount to accommodate the change in the blow-out amount, thereby ensuring stable paint spraying.

In case the blow-out amount is adjusted with compressed air, a small amount of air is fed through the throttle path under the action of the compressed air supplied into the container (in at least the same amount as the paint supply amount) and the compressed air is exhausted through a relief valve, which works as a compressed air regulating valve, so that no pressure is stored when the spraying is stopped. In this case, the compressed air is exhausted by the dripfree mechanism so that the paint inside the pressurizing container will not close the inlet of the compressed air.

These and other objects and advantages of the present invention will be better understood from the ensuing description, made by way of example, of the embodiments of the present invention with reference to the drawings.

BRIEF DESCRIPTION OF THE DRAWINGS

The drawings show one embodiment of the spray gun according to the present invention, wherein.

DETAILED DESCRIPTION OF THE PREFERRED EMBODIMENTS

Figure 1:
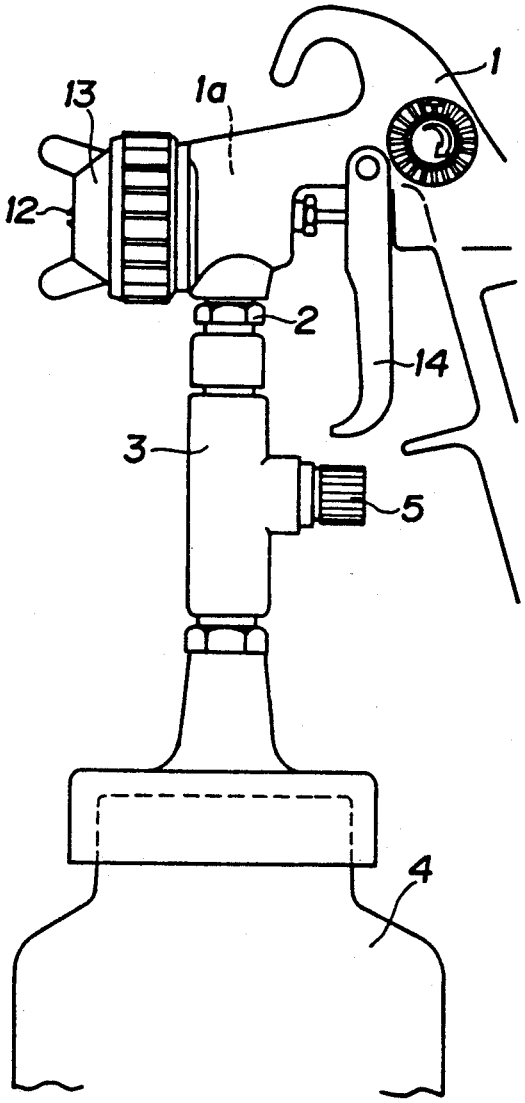
FIG. 1 is a side elevation showing a spray gun having a flow control valve according to the present invention.
Figure 2:
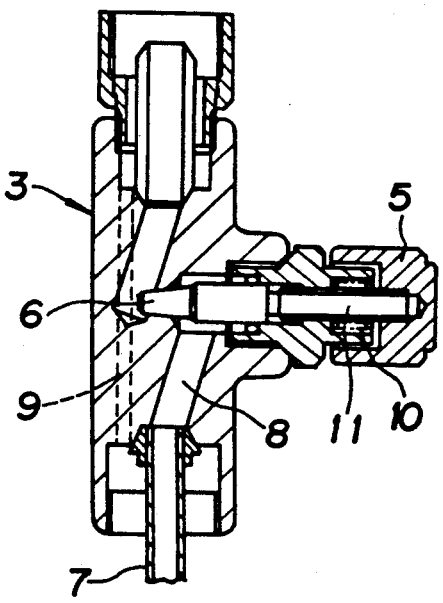
FIG. 2 is a sectional view, enlarged in scale, of the flow control valve of FIG. 1.

FIGS. 1 and 2 show a first embodiment of a spray gun in which a throttle valve is disposed in a paint supply path according to the present invention. Reference numeral 1 indicates a premixing-type spray gun body. A paint inlet of a paint nozzle or paint fitting la of this spray gun is provided with a flow control valve 3. Flow control valve 3 is removable and controls the path sectional area. A pressurizing container 4 is provided at the end of the flow control valve 3. The flow control valve 3 is provided at an intermediate portion thereof with a tapered valve seat 6 which slides to and fro by means of a knob 5. A paint pipe 7 faces the pressurizing container 4 and communicates with a paint path 8 disposed at the lower end of the flow control valve 3. By the above-described construction, the flow control valve can adjust the sectional area of the paint path. Reference numeral 9 indicates a compressed air path, 10 a spring and 11 a valve shaft. Also, reference numeral 12 indicates a spray nozzle, 13 an air cap, and 14 a trigger.

As the spraying pressure changes during spraying operation, the pressure applied to the outlet of the paint nozzle la changes, and the blow-out amount from the nozzle changes correspondingly. In this case, the preadjustment of the flow control valve 3 accommodates the change of the blow-out amount. Since the flow control valve 3 adjusts the paint supply amount by means of a valve body having a tapered surface and a valve seat, a fine flow adjustment can be done independently of the operation of the trigger 14, thus not spoiling the operability of the spray gun.

Figure 3:
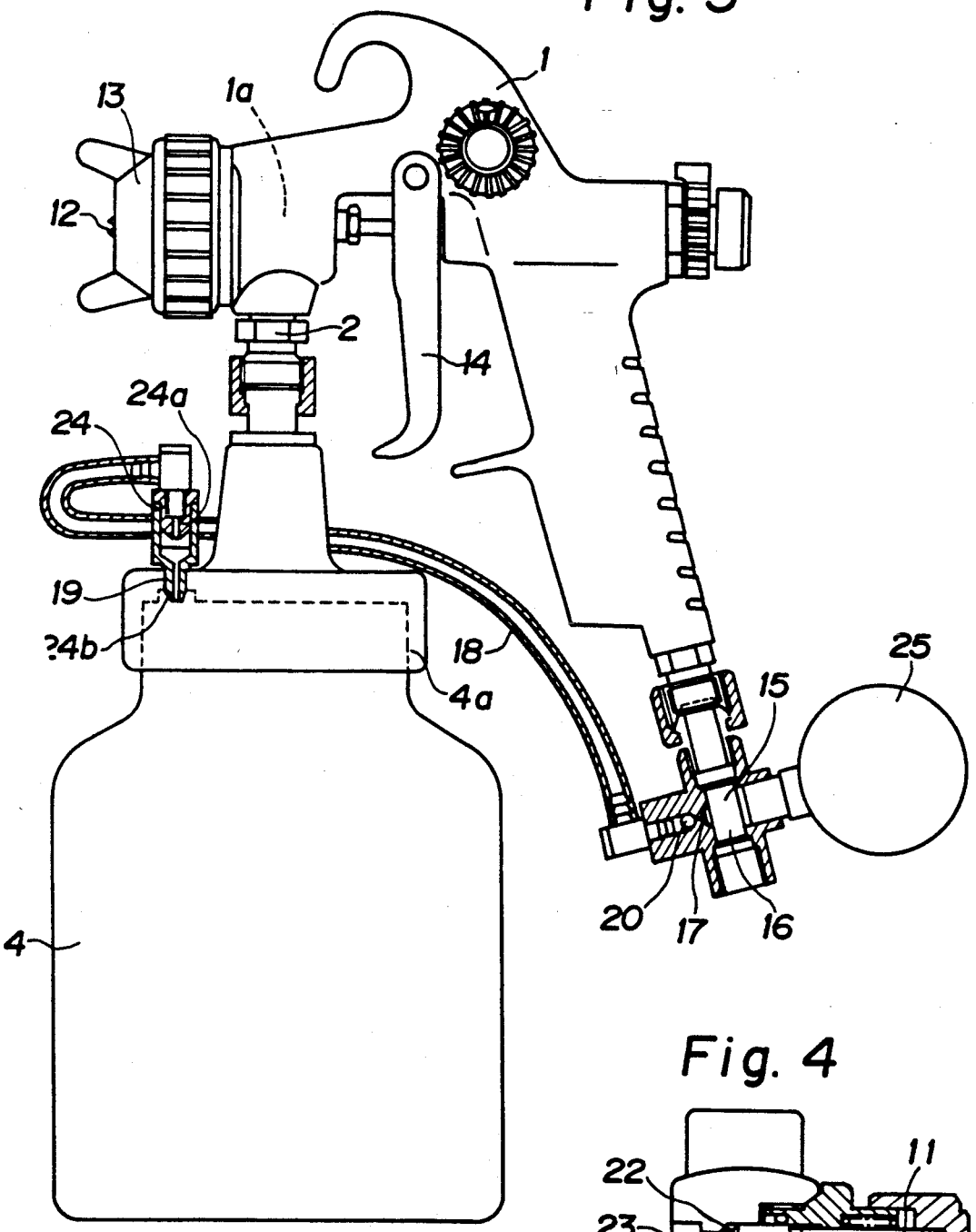
FIG. 3 is a side elevation of a second embodiment of the spray gun according to the present invention.
Figure 4:
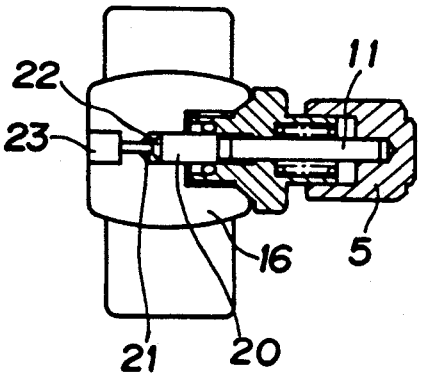
FIG. 4 is a sectional view, enlarged in scale, of a compressed air regulating valve.

FIGS. 3 and 4 illustrate a second embodiment of the present invention in which the paint supply amount is adjusted by the adjustment of the amount of compressed air.

For this purpose, an air inlet 15 at the base end of the handle of the spray gun body 1 is provided with a relief valve 16 serving as a compressed air adjusting valve. The relief valve 16 is provided with, in an air path thereof, a small throttle hole 17 branching the spraying air and communicating with an air inlet 19 of the pressurizing container 4. The branched air is partially exhausted from the relief valve 16 through a needle valve 20 before being supplied to a tube 18 connected to the air inlet 19. The needle valve 20 comprises a seat 21 and a valve 22, both being tapered. As the valve 22 moves axially, the clearance between the seat 21 and the valve 22 changes a little, and the compressed air is exhausted through the clearance to the atmosphere. As the taper angle inside is more acute, the adjustment with respect to axial movement can be made finer.

If too much compressed air is supplied into the pressurizing container, the internal pressure gradually rises and finally becomes the same as the spraying air pressure. For adjustment of the blow-out amount, the internal pressure has to be stabilized to a predetermined value through adjustment of the amount of relief through a relief hole 23 of the needle valve 20.

The pressurizing tube 18 is connected to a supply port provided in a cover 4*a* of the pressurizing container 4. The supply port is made as a dripfree mechanism 24, and a supply nozzle is provided in two stages, an internal nozzle 24*a* and an external nozzle 24*b*. The external nozzle 24*b* faces the paint in the container. To prevent paint from reversing through the nozzle 24*b*, an expanded portion or space is formed into which the internal nozzle 24*a* opens. When no spraying air is supplied, any paint having entered the nozzle is prevented from entering the internal nozzle 24*a*. The paint in the external nozzle 24*b* will be returned into the container by gravity or the next amount of supplied air. Reference numeral 25 in the drawing indicates a manometer.

As described in the foregoing, the spray gun having a paint supply amount control according to the present invention permits the adjustment of the supply amount or flow rate of the paint by means of the flow control valve provided in the paint supply path, adjusting the path sectional area and always maintaining a stable spray amount without spoiling the operability of the spray gun. Also, the flow control valve is removably provided in the paint supply path, and can thus be fitted only when necessary.

Because a compressed air adjusting mechanism is provided for introducing part of the spraying air pressure, the spray gun according to the present invention also permits control of the amount of paint supplied under pressure and thus maintains a stable spray amount without interference with the spray gun triggering operation. Also, the blow-out amount can be adjusted without any non-uniform paint-air mixing due to partial outflow from the nozzles, corresponding partial or uneven increases of the flow rate, and thus stable spray-painting can be performed.

Further, the dripfree mechanism in which the nozzles are disposed at two stages in the air inlet of the pressurizing container permits the prevention of the paint in the container from reversely flowing.

What is claimed is:

1. In a premixing-type paint spray gun having a paint spray nozzle, and a pressurized paint supply means for supplying paint under pressure to said paint spray nozzle, the improvement comprising:

a manually adjustable paint flow control valve removably connected between said pressurized paint supply means and said paint spray nozzle for adjusting the cross-sectional area of the flow path of pressurized paint through said flow control nozzle, said flow control valve having a valve housing having a flow control valve means therein and a compressed gas flow path therethrough bypassing said flow control valve means.

2. The improvement of claim 1, wherein said valve means includes a tapered valved seat, tapered valve body and an adjustment knob connected to said valve body.

3. The improvement of claim 2, wherein said valve housing has opposite ends and a paint path connecting said opposite ends, said valve seat being defined in said paint path and said compressed gas flow path extending through said valve housing between said opposite ends.

4. In a premixing-type paint spray gun having a paint spray nozzle, a compressed gas supply path for supplying compressed gas to said nozzle, and a pressurized paint supply means for supplying paint under pressure to said paint spray nozzle, the improvement comprising:

a compressed gas supply line extending from said compressed gas supply path to said pressurized paint supply means and having a throttle opening which opens thereinto from said compressed gas supply path;

a pressure relief valve in said compressed gas supply line downstream of said throttle opening; and a nozzle means at the end of said compressed gas supply line where it opens into said pressurized paint supply means for permitting compressed air to flow into said pressurized paint supply means while blocking return flow of paint into said compressed gas supply line, said nozzle means having a pair of nozzle in series with a paint accommodating chamber therebetween.

* * * * *